US010767667B2

(12) United States Patent
Guo et al.

(10) Patent No.: US 10,767,667 B2
(45) Date of Patent: Sep. 8, 2020

(54) ELECTRONICALLY CONTROLLED VALVE, HYDRAULIC PUMP, AND HYDRAULIC PUMP SYSTEM

(71) Applicant: Danfoss Power Solutions (Zhejiang) Co. Ltd., Jiaxing, Zhejiang (CN)

(72) Inventors: Zhimin Guo, Zhejiang (CN); Stanislav Smolka, Ames, IA (US); Carsten Fiebing, Jevenstedt (DE)

(73) Assignee: Danfoss Power Solutions (Zhejiang) Co. Ltd., Jiaxing, Zhejiang (CN)

( * ) Notice: Subject to any disclaimer, the term of this patent is extended or adjusted under 35 U.S.C. 154(b) by 44 days.

(21) Appl. No.: 15/812,516

(22) Filed: Nov. 14, 2017

(65) Prior Publication Data

US 2018/0135660 A1 May 17, 2018
US 2018/0335056 A9 Nov. 22, 2018

(30) Foreign Application Priority Data

Nov. 16, 2016 (CN) ..... 2016 1 1030563

(51) Int. Cl.
*F15B 11/042* (2006.01)
*F15B 11/17* (2006.01)
(Continued)

(52) U.S. Cl.
CPC ..... *F15B 11/17* (2013.01); *F04B 1/26* (2013.01); *F04B 1/32* (2013.01); *F04B 49/002* (2013.01); *F04B 49/06* (2013.01); *F15B 11/0423* (2013.01); *F15B 2211/20538* (2013.01); *F15B 2211/20553* (2013.01); *F15B 2211/20576* (2013.01); *F15B 2211/63* (2013.01);
(Continued)

(58) Field of Classification Search
CPC ..... F15B 2211/20553; F15B 11/0423; F15B 2211/6652
See application file for complete search history.

(56) References Cited

U.S. PATENT DOCUMENTS 3,995,425 A * 12/1976 Wittren ..... F15B 11/165 60/445
4,617,854 A 10/1986 Kropp
(Continued)

FOREIGN PATENT DOCUMENTS

CN 1272552 C 8/2006
CN 1821574 A 8/2006
(Continued)

OTHER PUBLICATIONS

"Hydraulic variable pump (motor) variable adjustment principle and application,"China Machine Press, pp. 103-109 and its English translation, dated Apr. 30, 2012.

*Primary Examiner* — F Daniel Lopez
(74) *Attorney, Agent, or Firm* — McCormick, Paulding & Huber PLLC

(57) ABSTRACT

The present invention relates to an electronically controlled valve for a variable displacement pump, a hydraulic pump and a hydraulic pump system with switchable control functions. Multiple control functions of different types of hydraulic pumps can be implemented via one single electronically controlled valve combined with control elements and sensors. The hydraulic pump systems can be easily integrated into the overall application systems for intelligent control.

6 Claims, 8 Drawing Sheets

(51) Int. Cl.

| | |
|---|---|
| ***F04B 49/00*** | (2006.01) |
| ***F04B 49/06*** | (2006.01) |
| ***F04B 1/32*** | (2020.01) |
| ***F04B 1/26*** | (2006.01) |

(52) U.S. Cl.
CPC . *F15B 2211/633* (2013.01); *F15B 2211/6309* (2013.01); *F15B 2211/6313* (2013.01); *F15B 2211/6333* (2013.01); *F15B 2211/6652* (2013.01); *F15B 2211/6655* (2013.01)

(56) References Cited

U.S. PATENT DOCUMENTS

| | | | | |
|---|---|---|---|---|
| 5,129,230 | A | 7/1992 | Izumi et al. | |
| 5,758,499 | A | 6/1998 | Sugiyama et al. | |
| 6,053,707 | A | 4/2000 | Itsuji et al. | |
| 6,375,433 | B1 * | 4/2002 | Du | F04B 1/324 417/53 |
| 6,971,232 | B2 | 12/2005 | Singh | |
| 7,086,225 | B2 | 8/2006 | Kadlicko | |
| 7,987,668 | B2 | 8/2011 | Kakino et al. | |
| 8,495,871 | B2 * | 7/2013 | Bitter | E02F 9/2235 60/443 |
| 8,511,080 | B2 * | 8/2013 | Krajnik | E02F 9/2235 60/422 |
| 2015/0075148 | A1 * | 3/2015 | Yamaji | F04B 49/06 60/420 |

FOREIGN PATENT DOCUMENTS

| | | | |
|---|---|---|---|
| CN | 100392246 | C | 6/2008 |
| CN | 101372942 | A | 2/2009 |
| CN | 104847613 | A | 8/2015 |
| DE | 69628529 | T2 | 4/2004 |
| DE | 102015225933 | A1 | 7/2016 |
| EP | 2105638 | A1 | 9/2009 |
| EP | 1978248 | B1 | 8/2015 |
| JP | 2011153527 | A | 8/2011 |
| KR | 20120026199 | A | 3/2012 |
| KR | 101328780 | B1 | 11/2013 |
| KR | 20140002296 | A | 1/2014 |
| KR | 20140003852 | A | 1/2014 |

* cited by examiner

Electrically proportional displacement control

Electrically proportional displacement control
(with a hydraulic control safety valve)

Pressure compensation control

Pressure compensation control
(with a hydraulic control safety valve)

Constant power (torque) control

Constant power (torque) control
(with a hydraulic control safety valve)

ELECTRONICALLY CONTROLLED VALVE, HYDRAULIC PUMP, AND HYDRAULIC PUMP SYSTEM

CROSS-REFERENCE TO RELATED APPLICATION

This application claims foreign priority benefits under U.S.C. § 119 to Chinese Patent Application No. 201611030563.0 filed on Nov. 16, 2016, the content of which is hereby incorporated by reference in its entirety.

TECHNICAL FIELD

The present invention relates to hydraulic technology, especially relates to an electronically controlled valve, a hydraulic pump with the electronically controlled valve, and a hydraulic pump system with switchable control functions.

BACKGROUND ART

A hydraulic pump is a power source in a hydraulic system, it converts mechanical energy from a driving motor or an engine into hydraulic energy for the hydraulic system's use. Different hydraulic systems or one hydraulic system in different working conditions has different requirements for pressure source, this requires that the hydraulic pump should have different control types to meet such requirements.

Control types for current hydraulic pumps are implemented mostly by using traditional mechanically controlled valves. For these mechanically controlled valves, a specific control function is implemented by a specific mechanical structure, and the combination of multiple functions is based on simple physical addition of single function. These mechanically controlled valves are complicated in structure and require a great variety of parts, which increases complexity of the assembly line and may cause errors easily. On the other hand, development period for these mechanically controlled valves is quite long, which results in higher investment and higher product cost. Furthermore, set values for each function of these mechanically controlled valves must be adjusted manually on a test stand, this is quite inflexible.

With the development of information technology and network technology, more and more hydraulic systems require seamless integration of hydraulic pumps to achieve digitalized and intelligent control for improving working efficiency of the hydraulic system, the traditional mechanically controlled valves cannot meet such requirement.

SUMMARY

An objective of the present invention is to provide an electronically controlled valve, a hydraulic pump based on an electronically controlled valve, and a hydraulic pump system with switchable control functions for at least partially solving at least one aspect of the aforementioned problems and mitigating or at least partially eliminating defects and deficiencies exist in the prior art.

To achieve the aforementioned objective, according to a first aspect of the present invention, an electronically controlled valve for a variable displacement pump is provided. The electronically controlled valve comprises: a control valve housing; a spool mounted displace-ably inside the control valve housing; and a spool control component. The spool control component works in at least three current levels to enable the spool to shift among at least three correspondent working positions: when the spool control component operates in an intermediate current $I_M$, the spool works in a middle position enabling the displacement of the variable displacement pump to keep constant; and when the spool control component operates in one of a high current $I_H$ higher than the intermediate current $I_M$ and a low current $I_L$ lower than the intermediate current $I_M$, the spool works in a working position enabling the displacement of the variable displacement pump to keep increasing or decreasing.

According to an embodiment of the present invention, the electronically controlled valve is a digital valve, and the intermediate current $I_M$, the high current $I_H$ and the low current $I_L$ are respectively discrete current values.

According to an embodiment of the present invention, the high current $I_H$ of the electronically controlled valve is a current value within a continuous range higher than the intermediate current $I_M$; and the low current $I_L$ is a current value within a continuous range lower than the intermediate current $I_M$.

According to an embodiment of the present invention, the spool control component comprises: an electrical actuator and an adjusting spring. The electrical actuator and the adjusting spring are provided oppositely at two ends of the control valve housing and act on the spool in opposite direction. The electrical actuator applies different forces to the spool according to the current levels to move the spool to a correspondent working position.

According to an embodiment of the present invention, a predetermined spring force of the adjusting spring can be changed to adjust the value of the intermediate current $I_M$ for the spool.

According to an embodiment of the present invention, the electronically controlled valve is arranged in a symmetrical structure, and positions of the electrical actuator and the adjustment spring at the two ends of the control valve housing are interchangeable.

According to an embodiment of the present invention, the control valve housing comprises: an inlet P which is in fluid communication with a pump outlet of the variable displacement pump; a work port A which is in fluid communication with a servo-mechanism for adjusting the displacement of the variable displacement pump; and an outlet T which is in fluid communication with a pump housing of the variable displacement pump. When the spool control component operates in the intermediate current $I_M$, the electronically controlled valve works in the middle position, and the inlet P, the work port A and the outlet T are uncommunicated with each other, thereby enabling the displacement of the variable displacement pump to keep constant. When the spool control component operates in one current level of the high current $I_H$ and the low current $I_L$, the spool is displaced to enable fluid communication of the work port A and the outlet T to make the displacement of the variable displacement pump keep increasing. When the spool control component operates in the other current level of the high current $I_H$ and the low current $I_L$, the spool is displaced to enable fluid communication of the inlet P and the work port A to make the displacement of the variable displacement pump keep decreasing.

In addition, according to another aspect of the present application, a hydraulic pump based on the electronically controlled valve is provided. The hydraulic pump comprises: a variable displacement pump having a swash plate; an outlet piston chamber which is in constant communication with a pump outlet of the variable displacement pump, wherein, an outlet piston which is connected to an end of the swash plate is movably provided inside the outlet piston chamber; a servo piston chamber, wherein, a servo piston which is connected to the other end of the swash plate is movably provided inside the servo piston chamber; and the aforementioned electronically controlled valve, wherein, the electronically controlled valve is respectively in fluid communication with the pump outlet of the variable displacement pump, a pump housing, and the servo piston chamber through three ports on the control valve housing. The servo piston and the outlet piston act jointly on the swash plate to adjust an angle of the swash plate for changing the displacement of the variable displacement pump.

According to an embodiment of the present invention, the three ports of the electronically controlled valve respectively are: an inlet P which is in fluid communication with the pump outlet of the variable displacement pump; a work port A which is in fluid communication with the servo piston chamber; and an outlet T which is in fluid communication with the pump housing of the variable displacement pump. When the spool control component operates in the intermediate current $I_M$, the electronically controlled valve works in the middle position, and the inlet P, the work port A and the outlet T are uncommunicated with each other, thereby enabling the displacement of the variable displacement pump to keep constant. When the spool control component operates in one current level of the high current $I_H$ and the low current $I_L$, the spool is displaced to enable fluid communication of the work port A and the outlet T to make the displacement of the variable displacement pump keep increasing. When the spool control component operates in the other current level of the high current $I_H$ and the low current $I_L$, the spool is displaced to enable fluid communication of the inlet P and the work port A to make the displacement of the variable displacement pump keep decreasing.

According to an embodiment of the present invention, the hydraulic pump further comprises a hydraulic control safety valve which is connected between the pump outlet and the servo piston chamber, the hydraulic control safety valve is configured to be opened when pressure at the pump outlet exceeds a predetermined value to enable a fluid to flow through the hydraulic control safety valve to enter into the servo piston chamber, thereby decreasing the displacement of the variable displacement pump, and closed when the pressure at the pump outlet does not exceed the predetermined value.

According to an embodiment of the present invention, the hydraulic control safety valve comprises: a safety valve housing; a hydraulic control spool, wherein, the hydraulic control spool is displace-ably mounted inside the safety valve housing; a hydraulic path, wherein, the hydraulic path is in fluid communication with the pump outlet, and enable the pressure of the pump outlet to act on the hydraulic control spool; and a set spring, wherein the set spring acts on the hydraulic control spool in a direction opposite to the action direction of the hydraulic path, and sets the predetermined value.

In addition, according to still another aspect of the present invention, a hydraulic pump system is provided. The hydraulic pump system comprises: the aforementioned hydraulic pump; at least one sensor which is connected to the hydraulic pump; and a controller which has at least one input end connected to the sensor and an output end connected to an electrical actuator of the electronically controlled valve of the hydraulic pump to perform control.

According to an embodiment of the present invention, the at least one sensor comprises at least one sensor selected from a group of the following sensors: an angle sensor which is used to detect an angle of the swash plate of the hydraulic pump; a first pressure sensor which is used to detect pump outlet pressure of the hydraulic pump; a speed sensor which is used to detect a rotation speed of the hydraulic pump; and a second pressure sensor which is used to detect load pressure.

According to an embodiment of the present invention, the output of the at least one sensor can be used for different control functions, and the at least one sensor and the controller are combined to form at least one of the following control configurations to perform at least one control function of the hydraulic pump: an electric proportional displacement control configuration which comprises the angle sensor and the controller, wherein, the controller calculates the displacement of the hydraulic pump based on an angle signal sensed by the angle sensor and control the electronically controlled valve to change the displacement of the hydraulic pump until a required displacement is reached; a pressure compensation control configuration which comprises the first pressure sensor and the controller, wherein the controller compares pump outlet pressure of the hydraulic pump detected by the first pressure sensor with a predetermined maximum working pressure, and controls the electronically controlled valve to change the displacement of the hydraulic pump to the minimum and keep the state when the pump outlet pressure of the hydraulic pump reaches to the predetermined maximum working pressure, and change the displacement of the hydraulic pump to the maximum and keep the state when the pump outlet pressure of the hydraulic pump is less than the predetermined maximum working pressure; a constant power control configuration which comprises the angle sensor, the speed sensor, the first pressure sensor and the controller, wherein, the controller calculates an input power of the pump based on the pump outlet pressure, the angle of the swash plate, the rotation speed and work efficiency of the hydraulic pump, and controls the electronically controlled valve to change the displacement of the hydraulic pump to maintain the input power of the hydraulic pump at a set value; and a load sensing control configuration which comprises the first pressure sensor, the second pressure sensor and the controller, wherein, the controller monitors the pressure values from the first pressure sensor and the second pressure sensor, and compares the delta value between the pressure values with a predetermined load sensing set value, in case the delta value is not equal to the load sensing set value, the controller controls the electronically controlled valve to change the displacement of the hydraulic pump until the delta value is equal to the load sensing set value.

The beneficial technique effects of the present invention include:

First, multiple control functions of different types of hydraulic pumps can be implemented via one single electronically controlled valve. Secondly, set parameters of control functions of hydraulic pumps can be changed conveniently, so that flexibility of hydraulic pump systems can be improved prominently and energy saving of hydraulic pump systems can be achieved, thereby improving efficiency of the overall application systems where the hydraulic pump systems are applied. Third, the control of the hydraulic pumps become more intelligent, and the integration of the hydraulic pumps with the overall application systems becomes very easy. Moreover, configurations of all control functions and priority levels of the control functions can be defined according to actual application requirements of customers. Furthermore, hydraulic pumps that exist in the market currently can be conveniently upgraded according to the present invention. Finally, the hydraulic pump systems are more compact because the peripheral control elements and sensors can be selected and detachably installed into/on the hydraulic pump systems, thus the hydraulic pump systems can be installed into different overall application systems easily.

BRIEF DESCRIPTION OF THE DRAWINGS

The embodiments of the present invention are described with reference to the drawings, where reference numbers in the drawings represent correspondent components. The brief description of the drawings is as follows.

DETAILED DESCRIPTION

Figure 1:
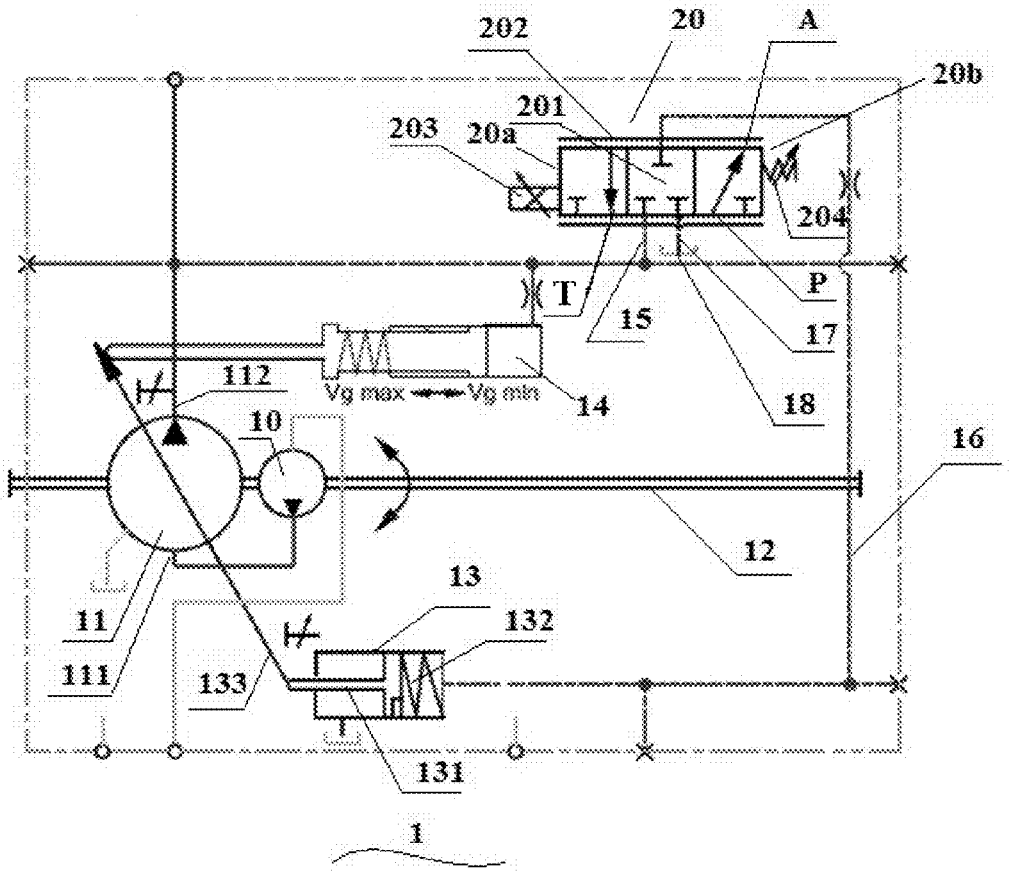
FIG. 1 is a schematic view of a hydraulic pump comprising an electronically controlled valve according to an embodiment of the present invention.

Technical solution of the present invention is explained in further detail below by way of embodiments in conjunction with FIGS. 1-8*b*. In this description, identical or similar reference numbers and letters indicate identical or similar components. The following description of embodiments of the present invention with reference to the drawings is intended to explain the general inventive concept of the present invention, and should not be interpreted as a limitation of the present invention.

Drawings are used to describe the contents of the present invention. Size and shape of components in the drawings do not reflect actual proportions of components in a hydraulic pump and a system comprising the hydraulic pump.

According to the general concept of the present invention, an electronically controlled valve is provided. The electronically controlled valve comprises: a control valve housing, a spool, an electrical actuator and an adjusting spring. The control valve housing comprising a P port, an A port and a T port. The P port is in communication with a pump outlet of a variable displacement pump via a first path. The A port is in communication with a servo piston chamber via a second path. The T port is in communication with a pump housing via a third path. The spool is mounted displace-ably inside the control valve housing. The electrical actuator is connected to the spool at one end of the control valve housing and the adjusting spring is provided at the other end of the control valve housing, thus the adjusting spring and the electrical actuator act on the spool oppositely. The spool works in three positions. When the spool works in a middle position, the P port, the A port and the T port are uncommunicated from each other; when the spool works in a servo pressure-decreasing position, the spool is in a position that enables communication between the A port and the T port; when the spool works in a servo pressure-increasing position, the spool is in a position that enables communication between the P port and the A port. The electrical actuator works in three current levels to enable the spool to shift among the three working positions. When the electrical actuator works in an intermediate current $I_M$, the spool is in the middle position; when the electrical actuator works in a current level different from the intermediate current $I_M$, the spool is moved to the servo pressure-decreasing position or the servo pressure-increasing position in the control valve housing. This current level which is different from the intermediate current $I_M$ may be a high current $I_H$ higher than the intermediate current $I_M$ or a low current $I_L$ lower than the intermediate current $I_M$.

As an exemplary embodiment, the electronically controlled valve is a three-position three-way electronically controlled valve with one end provided with an electrical actuator and one end provided with an adjusting spring, and the electrical actuator and the adjusting spring are interchangeable to implement positive control or negative control.

As an exemplary embodiment, the electronically controlled valve is a digital valve, and the intermediate current $I_M$, the high current $I_H$ and the low current $I_L$ are respectively discrete current values.

As an exemplary embodiment, the electrical actuator comprises, but is not limited to, a solenoid, a proportional solenoid, a relief valve, an electric proportional relief valve.

FIG. 1 is a schematic view of a hydraulic pump comprising an electronically controlled valve according to an embodiment of the present invention. As shown in FIG. 1, the hydraulic pump 1 comprises: a variable displacement pump 11 which is driven by a driving shaft 12, an electronically controlled valve 20, a servo piston chamber 13 and an outlet piston chamber 14. The variable displacement pump 11 is, for example, an axial piston pump having a swash plate 133. The angle of the swash plate 133 is adjusted by joint action of a servo piston 131 and an outlet piston which are connected respectively to two ends of the swash plate 133. The electronically controlled valve 20 is, for example, a three-position three-way digital valve with its spool in a middle position (shown in FIG. 1). The servo piston chamber 13 is provided with the servo piston 131 and a first spring 132 inside. The outlet piston chamber 14 comprises the outlet piston and a second spring.

In addition, the hydraulic pump 1 may further comprise a constant displacement pump 10. The constant displacement pump 10 and the variable displacement pump 11, for example, are driven by the same driving shaft 12 and arranged in series connection. (for example, as shown in FIG. 1, the constant displacement pump 10 is located in an upstream of the variable displacement pump 11), thereby substantially forming a pump group.

The electronically controlled valve 20 is, for example, a digital valve, which comprises a spool 201, a control valve housing 202, a solenoid actuator 203 and an adjusting spring 204. The spool 201 is mounted displace-ably inside the control valve housing 202. The control valve housing 202 of the electronically controlled valve 20 comprises a P port, an A port and a T port. The P port is in communication with a pump outlet 112 of the variable displacement pump 11 via a first path 15. The A port is in communication with the servo piston chamber 13 via a second path 16. The T port is in communication with a pump housing 18 via a third path 17.

As shown in FIG. 1, the electronically controlled valve 20 is a three-position three-way valve, and works in at least three different current levels.

When the solenoid actuator 203 works in the high current $I_H$, it generates an electromagnetic force which is greater than a spring force of the adjusting spring 204, thereby enabling the spool 201 to move to a servo pressure-decreasing position, that is, a left position shown in FIG. 1 (a position close to the solenoid actuator 203). In this case, the A port is in communication with the T port, and the pressure in the servo piston chamber 13 reduces. As the outlet piston chamber 14 is in constant communication with the pump outlet 112, the outlet piston drives the swash plate 133 to rotate under the action of the high pressure of the pump outlet 112 of the variable displacement pump 11, and the tilt angle of the swash plate 133 increases. The servo piston is driven by the swash plate 133 to move in an opposite direction, and the first spring 132 of the servo piston chamber 13 ensures constant contact between the servo piston 131 and the swash plate 133. In this case, the displacement of the variable displacement pump 11 keeps increasing.

Moreover, as shown in FIG. 1, when the solenoid actuator 203 works in the low current $I_L$, it generates an electromagnetic force which is smaller than a spring force of the adjusting spring 204, as a result, the spool 201 moves to a servo pressure-increasing position, that is, a right position shown in FIG. 1 (a position close to the adjusting spring 204). In this case, the P port is in communication with the A port, and the servo piston chamber 13 is in communication with the pump outlet 112. The servo piston 131 drives the swash plate 133 to rotate under the action of the high pressure of the pump outlet 112 of the variable displacement pump 11, and the tilt angle of the swash plate 133 decreases. The outlet piston is driven by the swash plate 133 to move in an opposite direction, and the second spring of the outlet piston chamber 14 ensures constant contact between the outlet piston and the swash plate 133. In this case, the displacement of the variable displacement pump 11 keeps decreasing.

Based on the aforementioned principle, when the solenoid actuator 203 works in a high current level to enable the displacement of the variable displacement pump 11 to increase, the electronically controlled valve 20 is conducting positive control. In contrast, when the solenoid actuator 203 works in a high current level to enable the displacement of the variable displacement pump 11 to decrease, the electronically controlled valve 20 is conducting negative control. As the electronically controlled valve 20 can be designed into a symmetrical structure, the adjusting spring 204 and the solenoid actuator 203 respectively at two ends of the electronically controlled valve 20 can be simply exchanged to obtain a positive control function or a negative control function. Furthermore, a predetermined spring force of the adjusting spring 204 can be changed to adjust the value of the intermediate current $I_M$ for the spool 201.

Figure 2:
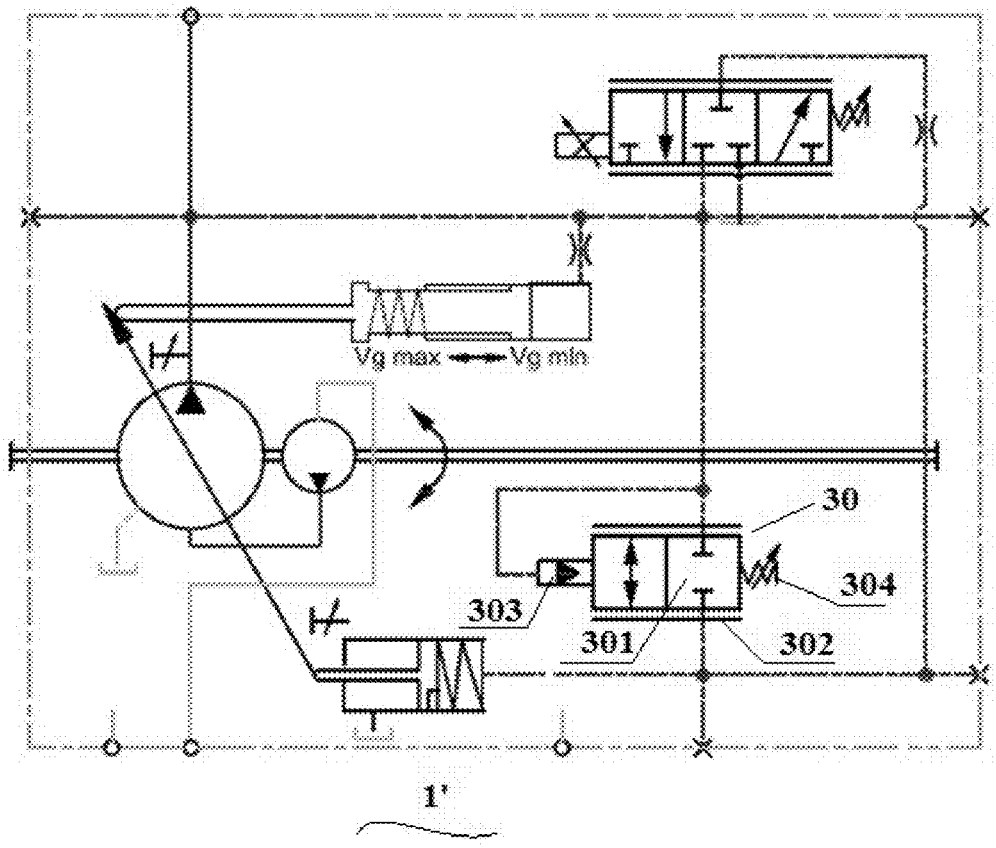
FIG. 2 is a schematic view of a hydraulic pump comprising an electronically controlled valve according to another embodiment of the present invention, wherein, a hydraulic control safety valve is included.

FIG. 2 is a schematic view of a hydraulic pump 1' comprising an electronically controlled valve 20 according to another embodiment of the present invention. The hydraulic pump 1' further comprises a hydraulic control safety valve 30. The hydraulic control safety valve 30 is used to provide safety protection for the hydraulic pump 1' shown in FIG. 1. Specifically, the hydraulic control safety valve 30 is a two-position two-way valve which comprises a hydraulic control spool 301, a safety valve housing 302, a hydraulic path 303 and a set spring 304. When a hydraulic force generated by the pump outlet pressure of the variable displacement pump 11 acting on the hydraulic control spool 301 is greater than a set force of the set spring 304, the hydraulic control spool 301 works in a communicating position (left position as shown in FIG. 2). In this case, a high pressure fluid from the pump outlet 112 of the variable displacement pump 11 is in communication with the servo piston chamber 13, and the servo piston 13 de-strokes the variable displacement pump 11 to the minimum displacement under the action of the high pressure fluid. As there is no orifice between the servo piston chamber 13 and the hydraulic control safety valve 30, the variable displacement pump 11 can have a rapid response. The hydraulic control safety valve 30 acts as a safety protection device, it can be optionally included in the following described hydraulic pump systems comprising the electronically controlled valve 20. Details description of the hydraulic control safety valve 30 will be omitted for these hydraulic pump systems.

When each of the hydraulic pumps in FIG. 1 or FIG. 2 is equipped with a combination of controller(s) and sensor(s), a hydraulic pump system can be formed for implementing one or more control functions. In an actual application, a sensor is chosen according to a control function to be implemented, and multiple control functions can be implemented via the selected sensors. The sensor(s) can be selected to be detachably mounted in and connected to the hydraulic pump system for implementing certain control function(s). Alternatively, various sensors can be mounted in the hydraulic pump system in advance, and the implementation of a certain control function is realized by turning on or off sensor(s). The control functions comprise, but are not limited to, electric proportional displacement control, constant power control, pressure compensation control and load sensing control.

The aforementioned hydraulic pump system with various sensors mounted in advance will be described in detail hereafter, wherein, the implementation of a certain control function is realized by turning on or off sensor(s); and wherein, the electronically controlled valve comprised in this system conducts positive control in all following examples.

Figure 3:
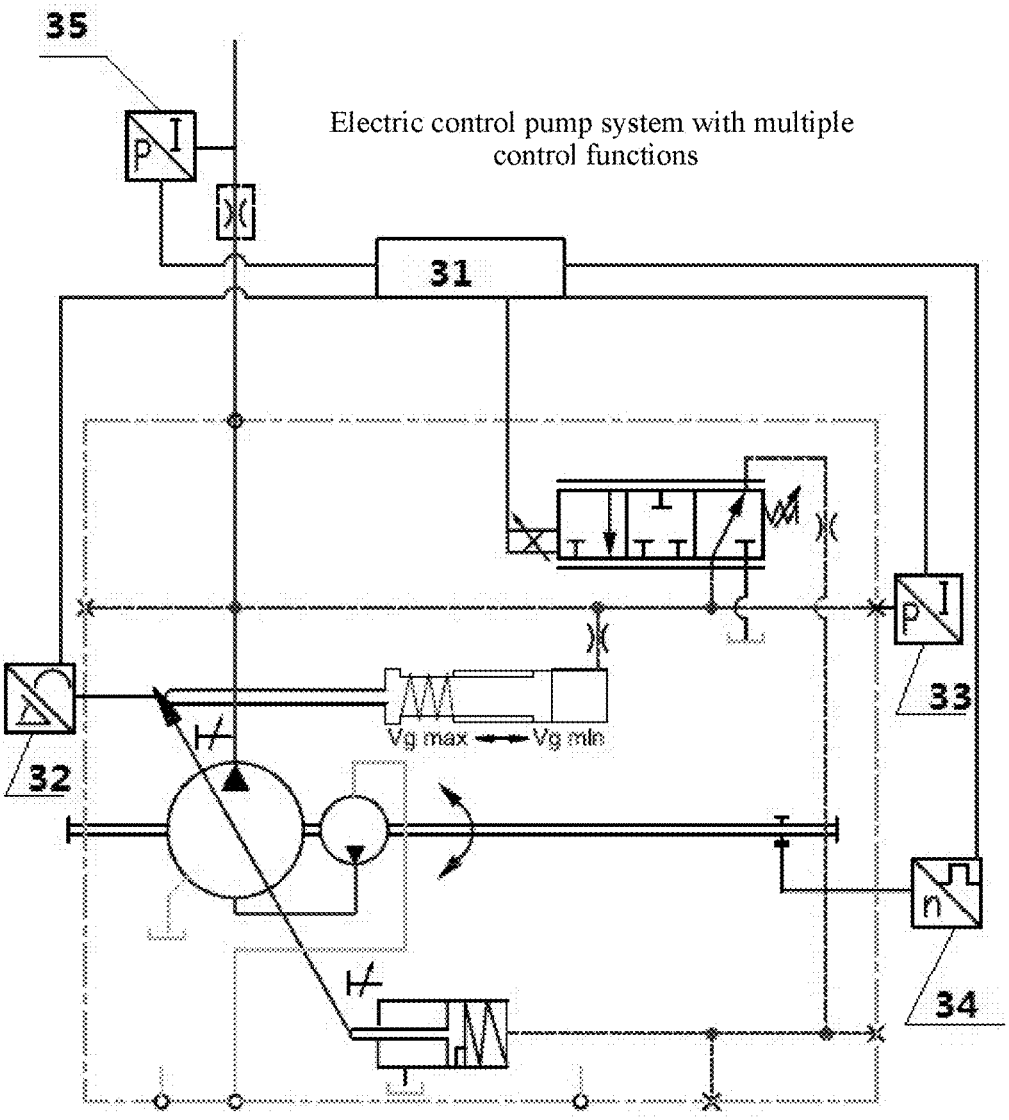
FIG. 3 is a schematic view of a hydraulic pump system comprising the hydraulic pump shown in FIG. 1.

Specifically, as shown in FIG. 3, the hydraulic pump 1 shown in FIG. 1 is installed with a controller 31 and several sensors. The sensors comprise, but are not limited to, an angle sensor 32, a first pressure sensor 33, a speed sensor 34 and a second pressure sensor 35. The controller 31 has at least one input end connected to a sensor and an output end connected to the solenoid actuator 203 of the electronically controlled valve 20 for controlling the solenoid actuator 203. The angle sensor 32 is used to detect a swashplate angle. The first pressure sensor 33 is used to detect pump outlet pressure. The speed sensor 34 is used to detect a rotation speed of the hydraulic pump 1. The second pressure sensor 35 is used to detect load pressure.

The hydraulic pump system shown in FIG. 3 with multiple control functions will be described in detail hereafter.

Wherein the implementation of a certain control function is realized by turning on or off sensor(s).

I. Electric Proportional Displacement Control

Figure 5A:
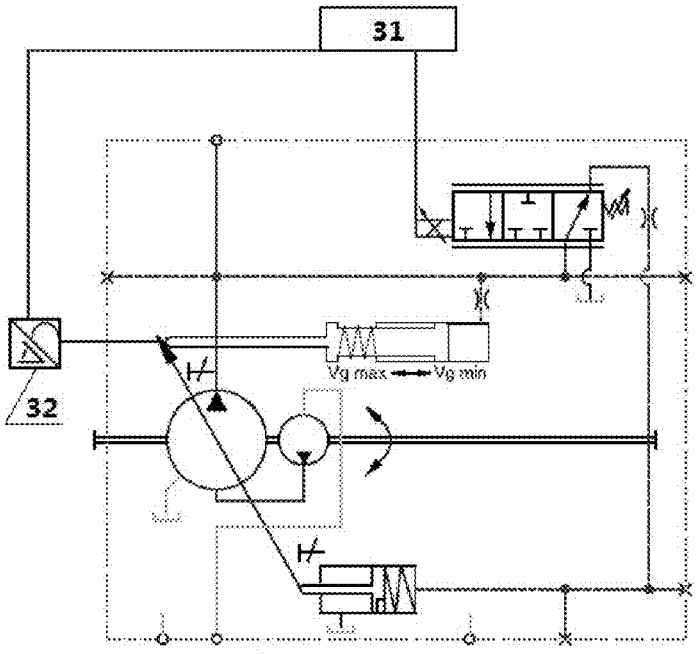
FIG. 5*a* is a schematic view of the hydraulic pump system as shown in FIG. 3 in an electric proportional displacement control mode.

FIG. 5*a* is a schematic view of the hydraulic pump system according to the embodiment of the present invention shown in FIG. 3 in an electric proportional displacement control mode, wherein, the first pressure sensor 33, the speed sensor 34 and the second pressure sensor 35 in the hydraulic pump system shown in FIG. 3 are turned off. Of course, the hydraulic pump system shown in FIG. 5*a* may also be obtained by mounting the controller 31 and the angle sensor 32 to the hydraulic pump 1 shown in FIG. 1.

In the hydraulic pump system shown in FIG. 5*a*, the electronically controlled valve 20 works with the controller 31 and the angle sensor 32 to implement electric proportional displacement control.

Specifically, when the hydraulic pump system needs to increase displacement, the controller 31 provides a high current $I_H$ to the solenoid actuator 203 to make the electronically controlled valve 20 work in the servo pressure-decreasing position, wherein, the A port and the T port are in fluid communication to enable communication between the servo piston chamber 13 and the pump housing 18, so that the displacement of the hydraulic pump 1 increases. During the process, the controller 31 monitors output of the angle sensor 32. When the displacement of the hydraulic pump 1 increases to meet the requirement of the system, the controller 31 provides an intermediate current $I_M$ to the solenoid actuator 203 to make the electronically controlled valve 20 work in the middle position, so that the hydraulic pump 1 keeps working at current displacement. Similarly, when the hydraulic pump system needs to decrease displacement, the controller 31 provides a low current $I_L$ to the solenoid actuator 203 to make the electronically controlled valve 20 work in the servo pressure-increasing position, wherein, the angle sensor 32 is used to monitor the swashplate angle when the displacement of the hydraulic pump decreases. When the required displacement is reached, the intermediate current $I_M$ is provided to the solenoid actuator 203 to make the electronically controlled valve 20 work in the middle position, so that the hydraulic pump 1 works stably at current displacement.

II. Pressure Compensation Control

Figure 6A:
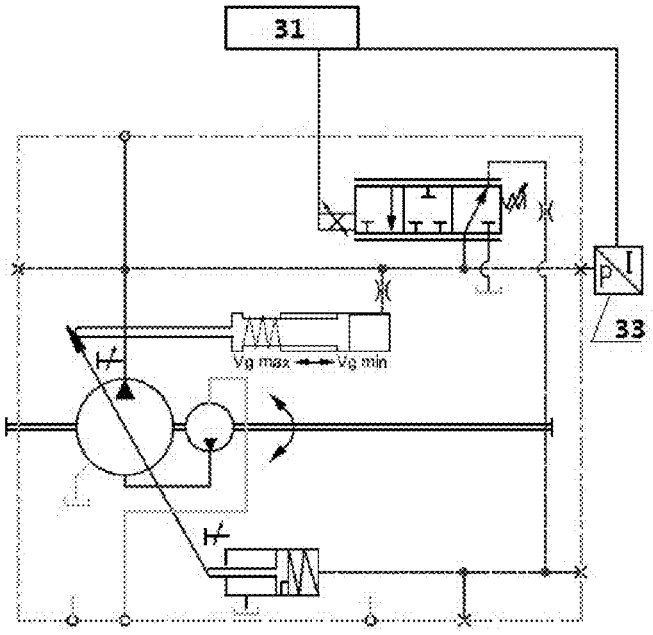
FIG. 6*a* is a schematic view of the hydraulic pump system as shown in FIG. 3 in a pressure compensation control mode.

FIG. 6*a* is a schematic view of the hydraulic pump system according to the embodiment of the present invention shown in FIG. 3 in a pressure compensation control mode, wherein, the angle sensor 32, the speed sensor 34, and the second pressure sensor 35 in the hydraulic pump system shown in FIG. 3 are turned off. Of course, the hydraulic pump system shown in FIG. 6*a* may also be obtained by mounting the controller 31 and the first pressure sensor 33 to the hydraulic pump 1 shown in FIG. 1.

In the hydraulic pump system shown in FIG. 6*a*, the electronically controlled valve 20 works with the controller 31 and the first pressure sensor 33 to implement pressure compensation control.

Specifically, when the hydraulic pump system works, the controller 31 detects and monitors pump outlet pressure of hydraulic pump 1 via the first pressure sensor 33. When the pump outlet pressure reaches to a predetermined maximum working pressure, the controller 31 provides the low current $I_L$ to the solenoid actuator 203 to make the electronically controlled valve 20 work in the servo pressure-increasing position. After the displacement of the hydraulic pump 1 decreases to the minimum level, the intermediate current $I_M$ is provided to the solenoid actuator 203 to keep the hydraulic pump 1 working stably at the minimum displacement. In case that the external load decreases and the pump outlet pressure decreases to a level lower than the predetermined maximum working pressure, the controller 31 provides the high current $I_H$ to the solenoid actuator 203 to increase the displacement of the hydraulic pump 1. When the displacement of the hydraulic pump 1 reaches to the maximum level, the intermediate current $I_M$ is provided to the solenoid actuator 203 to keep the hydraulic pump 1 working stably at the maximum displacement.

A pressure compensation set value which is used as a pressure comparison reference value may be set as different value for different application.

III. Constant Power (Torque) Control

Figure 7A:
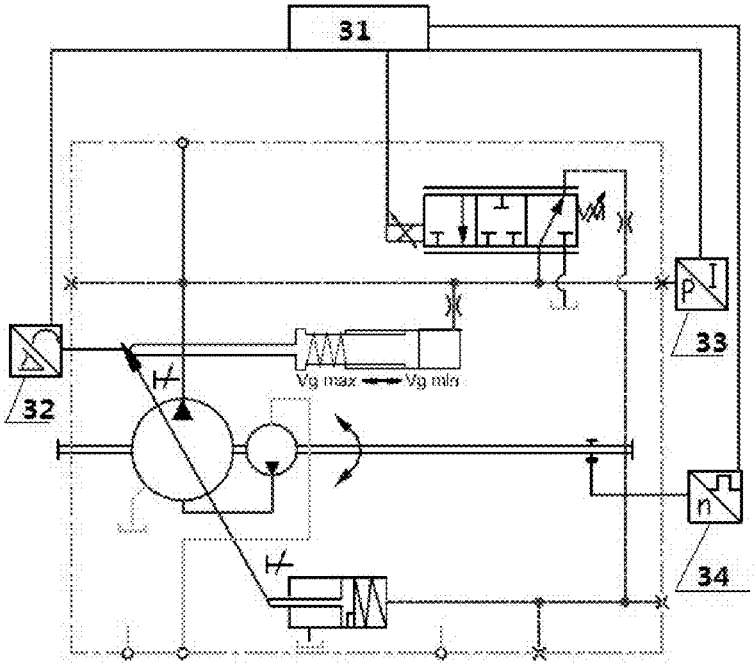
FIG. 7*a* is a schematic view of the hydraulic pump system as shown in FIG. 3 in a constant power control mode.

FIG. 7*a* is a schematic view of the hydraulic pump system according to the embodiment of the present invention shown in FIG. 3 in a constant power control mode, wherein, the second pressure sensor 35 in the hydraulic pump system shown in FIG. 3 is turned off. Of course, the hydraulic pump system shown in FIG. 7*a* may also be obtained by mounting the controller 31, the angle sensor 32, the speed sensor 34 and the first pressure sensor 33 to the hydraulic pump 1 shown in FIG. 1.

In the hydraulic pump system shown in FIG. 7*a*, the electronically controlled valve 20 works with the controller 31, the angle sensor 32, the speed sensor 34 and the first pressure sensor 33 to implement constant power (torque) control.

Specifically, when the hydraulic pump system works, the controller 31 monitors working pressure of the hydraulic pump 1 via the first pressure sensor 33, the swashplate angle via the angle sensor 32 and the pump rotation speed via the speed sensor 34, and then calculates a current input power of the hydraulic pump with consideration of the work efficiency of the hydraulic pump. When the input power of hydraulic pump 1 reaches to a set value, if working pressure of the hydraulic pump 1 needs to increase according to a system load, the controller 31 provides the low current $I_L$ to the solenoid actuator 203 to decrease the displacement of the hydraulic pump 1 to ensure that the input power of the hydraulic pump 1 is kept at the set value. If the system load decreases, the controller 31 provides the high current $I_H$ to the solenoid actuator 203 to increase the displacement of the hydraulic pump 1 to a level for maintaining the input power of the hydraulic pump 1 at the set value, or to the maximum level.

A constant power set value which is used as a power comparison reference value may be set as different value for different application.

IV. Load Sensing Control

Figure 8A:
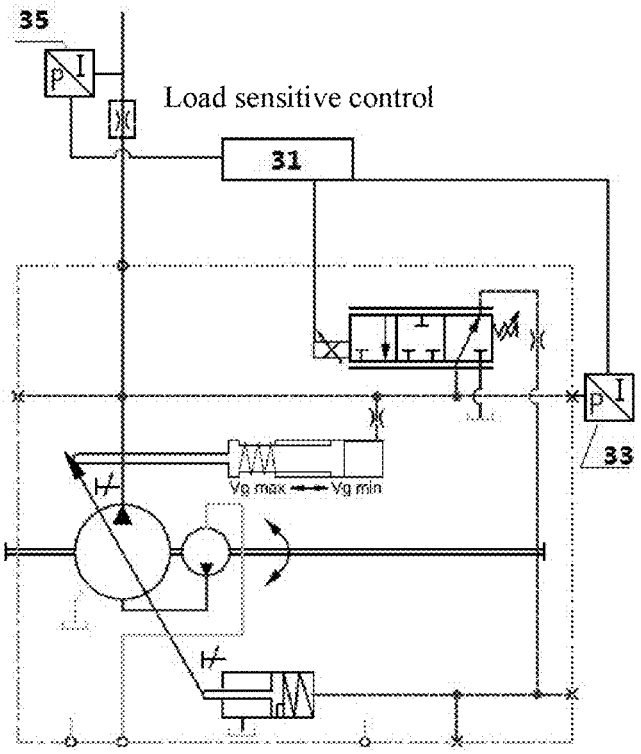
FIG. 8*a* is a schematic view of the hydraulic pump system as shown in FIG. 3 in a load sensing control mode.

FIG. 8*a* is a schematic view of the hydraulic pump system according to the embodiment of the present invention shown in FIG. 3 in a load sensing control mode, wherein, the angle sensor 32 and the speed sensor 34 in the hydraulic pump system shown in FIG. 3 are turned off. Of course, the hydraulic pump system shown in FIG. 8*a* may also be obtained by mounting the controller 31, the first pressure sensor 33 and the second pressure sensor 35 to the hydraulic pump 1 shown in FIG. 1.

In the hydraulic pump system shown in FIG. 8*a*, the electronically controlled valve 20 works with the controller 31, the first pressure sensor 33 and the second pressure sensor 35 to implement load sensing control.

Specifically, when the hydraulic pump system works, the first pressure sensor 33 monitors the pump outlet pressure, and the second pressure sensor 35 monitors load sensing feedback pressure. The controller 31 monitors and compares pressure values from the two pressure sensors. When the pump outlet pressure is not equal to a sum of the load sensing feedback pressure and a load sensing set value, the controller 31 provides one of the high current $I_H$ and the low current $I_L$ to the solenoid actuator 203 to change the displacement of the hydraulic pump 1 until the pump outlet pressure is equal to the sum of the feedback pressure and the load sensing set value, at this time, the controller 31 provides the intermediate current $I_M$ to the solenoid actuator 203 to keep the hydraulic pump 1 working stably in current state.

A load sensing set value which is used as a comparison reference value may be set to different value for different ideal load condition.

Similarly, based on the aforementioned embodiments, other embodiments may be implemented with changes and variations.

Figure 4:
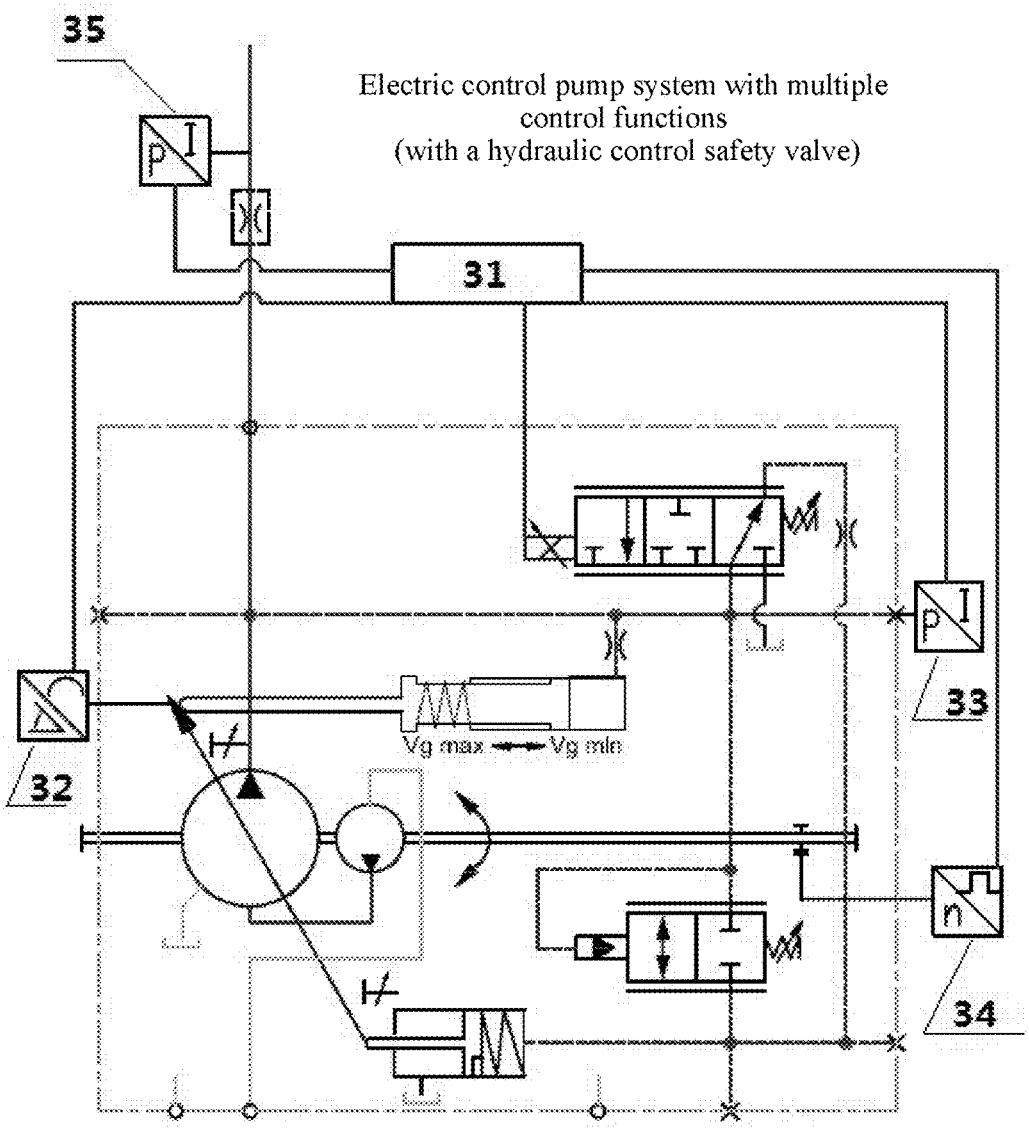
FIG. 4 is a schematic view of a hydraulic pump system comprising the hydraulic pump shown in FIG. 2.
Figure 5B:
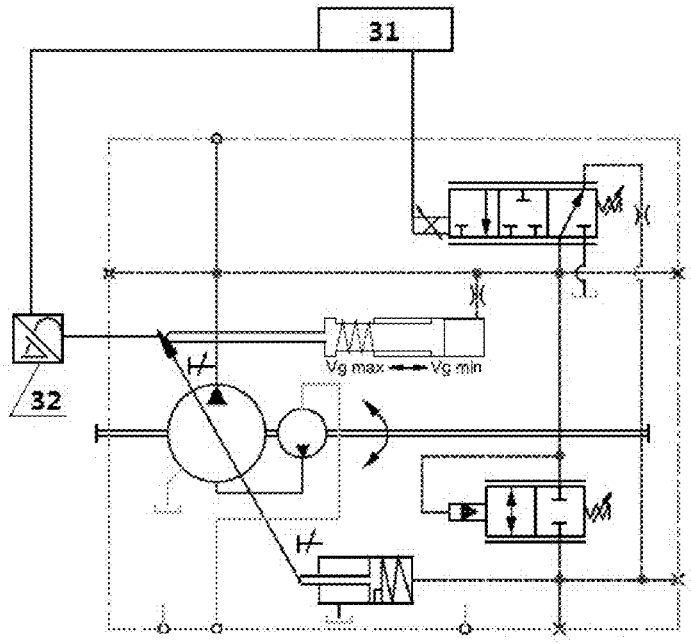
FIG. 5*b* is a schematic view of the hydraulic pump system as shown in FIG. 4 in an electric proportional displacement control mode.
Figure 6B:
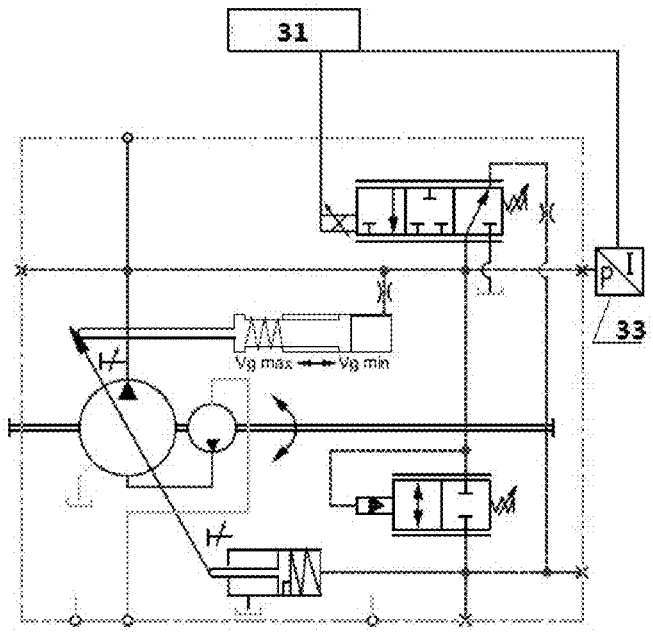
FIG. 6*b* is a schematic view of the hydraulic pump system as shown in FIG. 4 in a pressure compensation control mode.
Figure 7B:
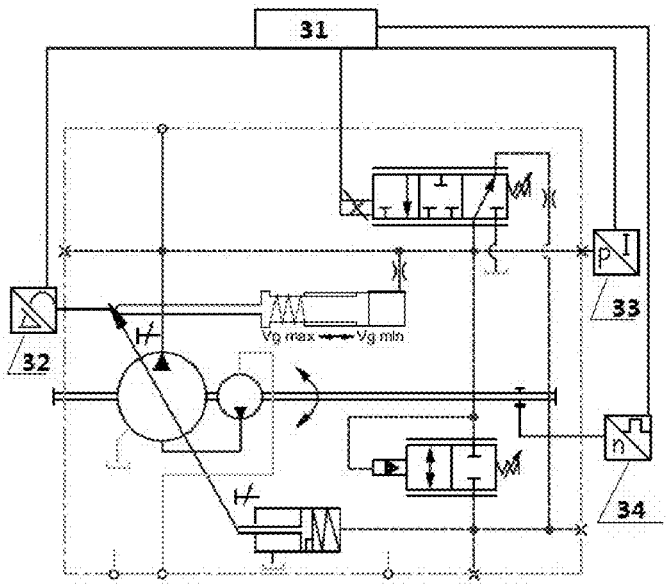
FIG. 7*b* is a schematic view of the hydraulic pump system as shown in FIG. 4 in a constant power control mode.
Figure 8B:
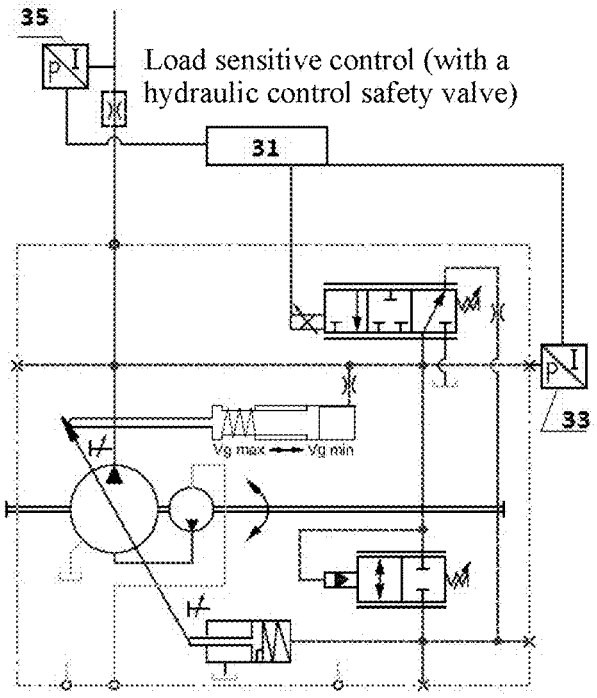
FIG. 8*b* is a schematic view of the hydraulic pump system as shown in FIG. 4 in a load sensing control mode.

FIG. 4 is a schematic view of a hydraulic pump system comprising the hydraulic pump shown in FIG. 2, wherein the hydraulic control safety valve 30 is included. FIG. 5*b* shows the hydraulic pump system of FIG. 4 in an electric proportional displacement control mode; FIG. 6*b* shows the hydraulic pump system of FIG. 4 in a pressure compensation control mode; FIG. 7*b* shows the hydraulic pump system of FIG. 4 in a constant power control mode; FIG. 8*b* shows the hydraulic pump system of FIG. 4 in a load sensing control mode.

In addition, according to the aforementioned embodiments of the present invention, it should be understood that any technical solution implementing a combination of any two or more of the aforementioned control functions via integration of required sensors also falls within the protection scope of the present invention.

It should be understood that the position terms such as "up", "down", "left" and "right" in the description of the present invention are used for explaining the position relationship shown in the drawings. These position terms should not be construed as limitation to the protection scope of the present invention.

The embodiments of the present invention are described in a progressive manner, and each embodiment focuses on differences from the other embodiments. The same or similar parts of the embodiments are referable for each other.

The description of the aforementioned embodiments is used to help understanding the present invention rather than to limit the scope of the present invention.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A hydraulic pump system comprising:

a hydraulic pump, the hydraulic pump comprising:

a variable displacement pump having a swash plate;

an outlet piston chamber which is in constant communication with a pump outlet of the variable displacement pump, wherein, an outlet piston which is connected to an end of the swash plate is movably provided inside the outlet piston chamber; and a servo piston chamber, wherein, a servo piston which is connected to the other end of the swash plate is movably provided inside the servo piston chamber;

an electronically controlled valve in fluid communication with the variable displacement pump;

a controller operatively connected to an actuator of the electronically controlled valve;

an angle sensor configured to detect a swashplate angle of the hydraulic pump;

a first pressure sensor configured to detect pump outlet pressure of the hydraulic pump;

a speed sensor configured to detect a rotation speed of the hydraulic pump; and a second pressure sensor configured to detect load pressure;

wherein the controller is configured to selectively operate between an electrically proportional displacement control mode, a pressure compensation control mode, a constant power control mode and a load sensitive control mode;

wherein, in the electrically proportional displacement control mode, the controller is configured to operate the actuator of the electronically controlled valve based on input from the angle sensor and not based on any input from the first pressure sensor, the speed sensor and the second pressure sensor;

wherein, in the pressure compensation control mode, the controller is configured to operate the actuator of the electronically controlled valve based on input from the first pressure sensor and not based on any input from the angle sensor, the speed sensor and the second pressure sensor;

wherein, in the constant power control mode, the controller is configured to operate the actuator of the electronically controlled valve based on input from the angle sensor, the first pressure sensor and the speed sensor and not based on any input from the second pressure sensor; and wherein, in the load sensitive control mode, the controller is configured to operate the actuator of the electronically controlled valve based on input from the first pressure sensor and the second pressure sensor not based on any input from the angle sensor and the speed sensor.

2. The hydraulic pump system according to claim 1, wherein the electronically controlled valve comprises:

a control valve housing;

a spool, wherein, the spool is mounted displace-ably inside the control valve housing; and a spool control component, wherein, the spool control component works in at least three current levels to enable the spool to shift among at least three correspondent working positions:

when the spool control component operates in an intermediate current ($I_M$), the spool shifts to a middle position enabling the displacement of the variable displacement pump to keep constant; and when the spool control component operates in one of a high current ($I_H$) higher than the intermediate current ($I_M$) and a low current ($I_L$) lower than the intermediate current ($I_M$), the spool shifts to a working position enabling the displacement of the variable displacement pump to keep increasing or decreasing.

3. The hydraulic pump system according to claim 2:

wherein the spool control component comprises the actuator and an adjusting spring;

wherein the actuator and the adjusting spring are provided oppositely at two ends of the control valve housing and act on the spool in opposite direction;

wherein the actuator applies different forces to the spool according to the current levels to move the spool to a correspondent working position; and wherein the spool control component operates in the high current ($I_M$), the spool shifts to a working position enabling the displacement of the variable pump to keep increasing.

4. The hydraulic pump system according to claim 2:

wherein the spool control component comprises the actuator and an adjusting spring;

wherein the actuator and the adjusting spring are provided oppositely at two ends of the control valve housing and act on the spool in opposite direction;

wherein the actuator applies different forces to the spool according to the current levels to move the spool to a correspondent working position; and wherein the spool control component operates in the high current ($I_M$), the spool shifts to a working position enabling the displacement of the variable pump to keep decreasing.

5. The hydraulic pump system according to claim 2, wherein the electronically controlled valve is respectively in fluid communication with the pump outlet of the variable displacement pump, a pump housing, and the servo piston chamber through three ports on the control valve housing.

6. The hydraulic pump system according to claim 5, wherein the servo piston and the outlet piston act jointly on the swash plate to adjust an angle of the swash plate for changing the displacement of the variable displacement pump.

* * * * *